US009586395B2

(12) United States Patent
Guidotti et al.

(10) Patent No.: US 9,586,395 B2
(45) Date of Patent: Mar. 7, 2017

(54) ACTUATOR AND METHOD OF DRIVING THEREOF

(71) Applicant: INGEGNERIA CERAMICA SRL, Sassuolo (MO) (IT)

(72) Inventors: Gianmario Guidotti, Modena (IT); Giovanni Barbanti, Casalecchio di Reno (IT); Marco Faretra, Longiano (IT)

(73) Assignee: I.C. S.R.L. CON SOCIO UNICO, Sassuolo (IT)

( * ) Notice: Subject to any disclaimer, the term of this patent is extended or adjusted under 35 U.S.C. 154(b) by 0 days.

(21) Appl. No.: 14/909,380

(22) PCT Filed: Jul. 31, 2014

(86) PCT No.: PCT/IB2014/063584

§ 371 (c)(1),
(2) Date: Feb. 1, 2016

(87) PCT Pub. No.: WO2015/015452

PCT Pub. Date: Feb. 5, 2015

(65) Prior Publication Data

US 2016/0176187 A1 Jun. 23, 2016

(30) Foreign Application Priority Data

Jul. 31, 2013 (GB) ..... 1313739.3

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01);
(Continued)

(58) Field of Classification Search
CPC B41J 2/04541; B41J 2/14201; B41J 2/04581; B41J 2/14209; B41J 2/04588; B41J 2202/05
See application file for complete search history.

(56) References Cited

U.S. PATENT DOCUMENTS 5,754,204 A * 5/1998 Kitahara ..... B41J 2/04581 347/70
6,213,594 B1 * 4/2001 Kitahara ..... B41J 2/14274 347/65

(Continued)

FOREIGN PATENT DOCUMENTS

DE WO 2005110759 A1 * 11/2005 ..... B41J 2/04
EP 0665106 A2 8/1995

(Continued)

*Primary Examiner* — Justin Seo
(74) *Attorney, Agent, or Firm* — Pearne & Gordon LLP

(57) ABSTRACT

An actuator (1), for a printhead, wherein the actuator (1) comprises: an actuating element (2) an obturator assembly (3), engageable with the actuator element (2); wherein the actuating element (2) is operable to assume, depending on a drive signal applied thereto: a rest configuration, in which the obturator assembly (3) is at a first distance (X0) from a reference plane (A); a first deformed configuration, in which the obturator assembly (3) is at a second distance (X1) from the reference plane (A) greater than the first distance (X0), and a second deformed configuration, in which the obturator assembly (3) is in contact with the reference plane (A), wherein: a control module (4) is configured for regulating a drive signal to the actuating element (2) to cause the obturator assembly (3) to move between the rest configuration and the first deformed configuration during a first operating cycle, to reduce the effects of impact on the obturator assembly.

20 Claims, 11 Drawing Sheets

(52) U.S. Cl.
CPC ..... *B41J 2/14201* (2013.01); *B41J 2/14209* (2013.01); *B41J 2202/05* (2013.01)

(56) References Cited

U.S. PATENT DOCUMENTS

| | | | | |
|---|---|---|---|---|
| 6,422,690 | B1 | 7/2002 | Harvey et al. | |
| 6,960,864 | B2 * | 11/2005 | Urano | F04B 43/0054 310/307 |
| 8,475,409 | B2 * | 7/2013 | Tsoukalis | A61M 5/14224 604/131 |
| 2008/0129769 | A1 | 6/2008 | Kim | |
| 2008/0246821 | A1 * | 10/2008 | Pauly | B41J 2/04 347/68 |
| 2011/0211001 | A1 * | 9/2011 | Uezawa | B41J 2/04528 347/10 |
| 2014/0292935 | A1 * | 10/2014 | Ito | B41J 2/14201 347/50 |
| 2015/0037501 | A1 | 2/2015 | Aparisi et al. | |

FOREIGN PATENT DOCUMENTS

| | | | | |
|---|---|---|---|---|
| EP | 1972450 | A2 | 9/2008 | |
| ES | 2386267 | A1 | 8/2012 | |
| GB | 201313738 D | * | 9/2013 | B41J 2/14201 |
| GB | 201313740 D | * | 9/2013 | B41J 3/407 |
| IT | EP 2842753 | A1 * | 3/2015 | B41J 2/14201 |
| WO | 9901284 | A1 | 1/1999 | |

* cited by examiner

Figure 10a
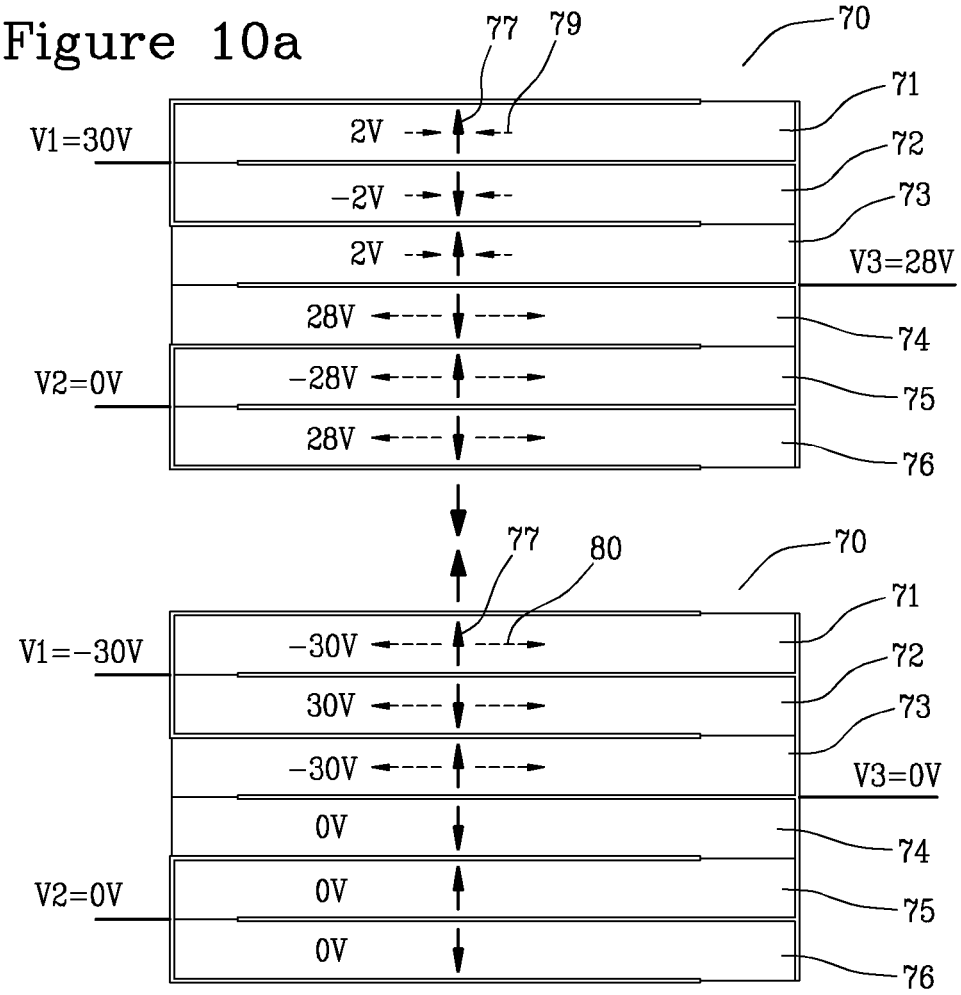
Figure 10b
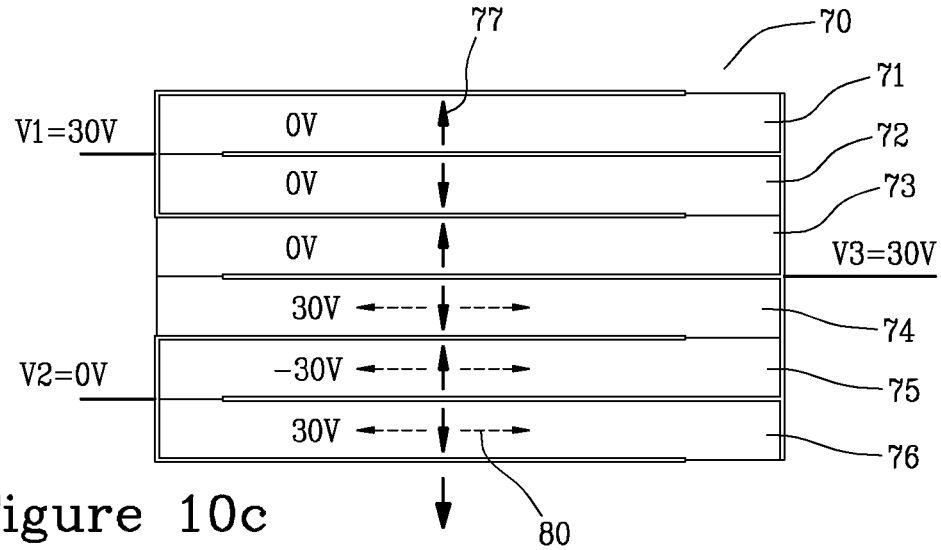
Figure 10c

Figure 11a
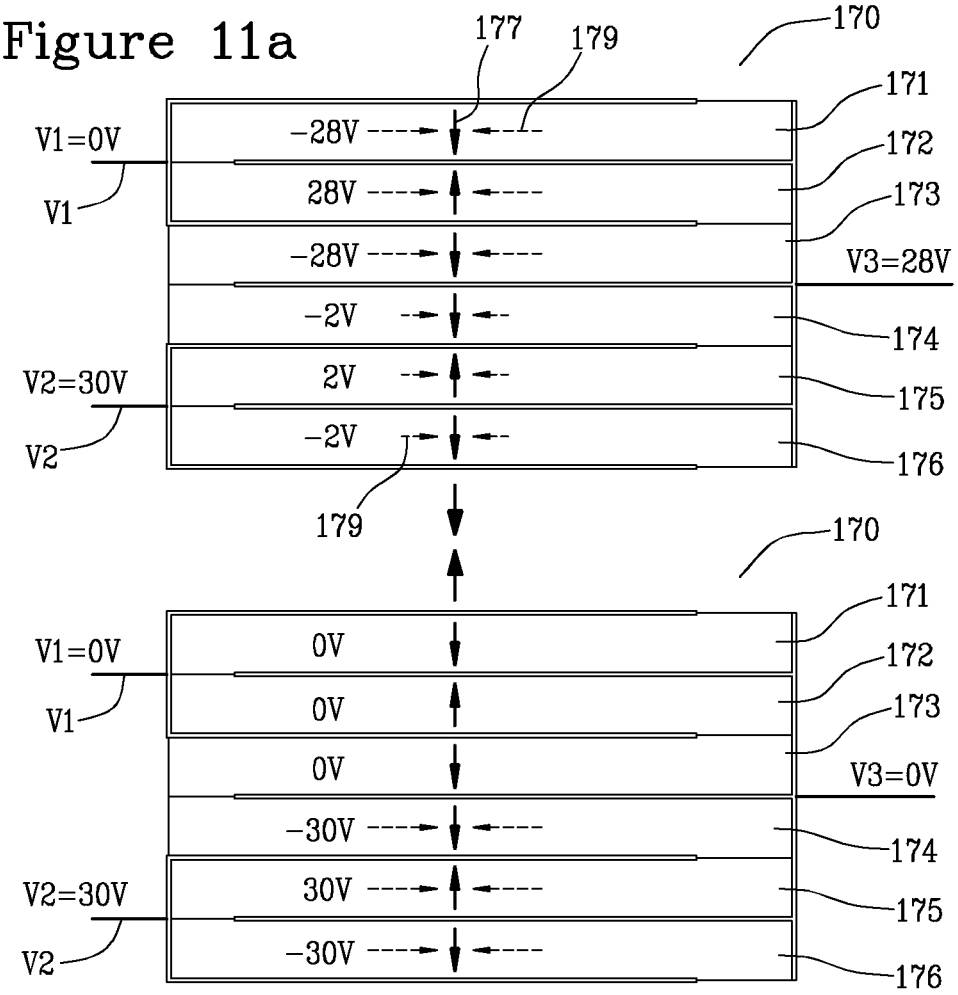
Figure 11b
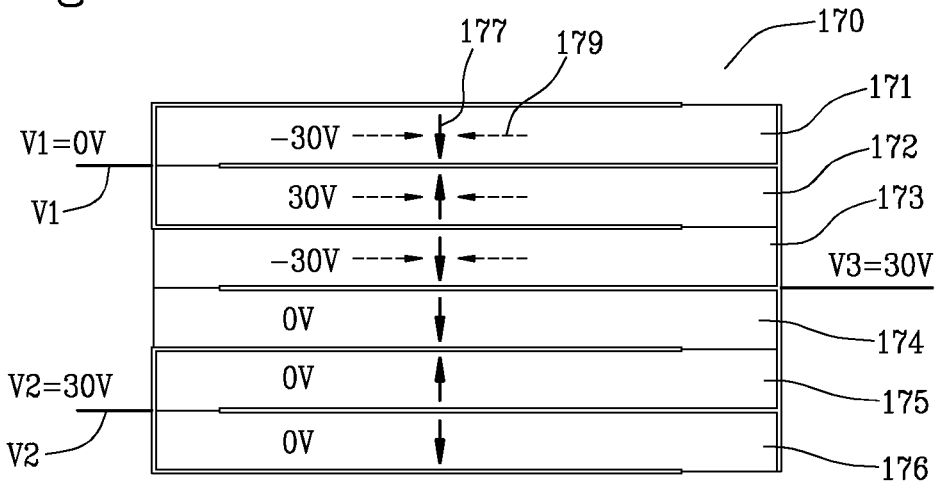
Figure 11c

ACTUATOR AND METHOD OF DRIVING THEREOF

The present invention relates to a printhead having an actuator and a method for driving the actuator, preferably but not exclusively, wherein the actuator is used in a printhead to effect droplet generation.

As is known, actuators convert electromagnetic energy into mechanical movement. For example a piezoelectric actuator comprises a piezoelectric element to which may be connected a structure/body on which it is desired to impart a controlled movement. The piezoelectric element, when subjected to an electric field E, is deformed from a first configuration to a second configuration, thereby effecting a corresponding movement of the body/structure connected to the piezoelectric element.

A particularly advantageous use of piezoelectric actuators relates to control of an obturator for closing/opening an entrance to a nozzle at a nozzle portion of an inkjet printhead to eject droplets therefrom.

An obturator is any mechanical element which is operable to engage with the nozzle/nozzle portion to provide a mechanical seal at the entrance to the nozzle, thereby preventing/reducing the flow of fluid into the nozzle.

For example, EP1972450B shows in section an example of a conventional printhead 200 used to print fluid (e.g. glaze or engobe) as shown in FIG. 1. The printhead 200 comprises a fluid chamber 202, having a fluid inlet (not shown) and fluid outlet (not shown), whereby the fluid 204 flows through the chamber 202 from the input to the output under a pressure of 1 Bar.

The printhead 200 comprises an actuator in the form of a piezoelectric element 206 having an obturator 207 coupled thereto and located inside the chamber 202, whilst the printhead 200 further comprises a nozzle portion 208 of the printhead, wherein the nozzle portion comprises at least one nozzle 209 provided therein, to provide a flow pathway from inside the chamber 202 to a substrate 210 through the nozzle 209.

The chamber 202 is provided with an elastomeric seal 212, to prevent the fluid exiting the chamber 202 at any point other than through the nozzle 209, or through the fluid outlet, whereby the seal is also operable to support the piezoelectric element 206 in the chamber 202, whilst enabling deflection of the piezoelectric element 206.

As the obturator 207 is directly coupled to the piezoelectric element 206, it moves in the direction of deflection of the piezoelectric element 206, and is configured to engage with the nozzle portion 208 to close the nozzle 209 when piezoelectric element 206 is in a non-deflected position/configuration, and to disengage from the nozzle portion 208 thereby opening the entrance to the nozzle 209, when the piezoelectric element 206 is in a deflected position.

In the conventional printhead 200 described above, a single layer piezoelectric element 206 is disclosed, whereby an electrode is secured in electrical connection with a first surface of the element 206, whilst a second electrode is secured in contact with a second surface of the element 206, and when an electric field, e.g. a voltage, is applied across the electrodes, actuation of the piezoelectric element 206 is achieved.

An electronic control module (not shown), is used to drive the actuator with a controllable drive signal such as a voltage waveform e.g. to drive the piezoelectric element 206 such that it deflects in an oscillatory manner at a certain frequency, for example, 1 kHz. By oscillating the piezoelectric element 206 between the non-deflected and deflected position it is possible to effect ejection of the fluid from the nozzle 209 in the form of droplets.

However, this method of driving causes wear on the obturator 207 and nozzle portion 208 resulting from continual impact between the obturator 207 and the nozzle portion 208.

For example, progressive damage of the obturator 207 and/or nozzle portion 209 and/or nozzle 209 (such as pock marks/channels due to cavitation/frictional wear), causes sealing problems within the chamber 202, or leakage problems from the chamber 202 when the obturator 207 is in the non-deflected position.

An object of the present invention is to offer an improved actuator and a method for driving the actuator which addresses the drawbacks described above. The invention is particularly suited to applications in inkjet printing.

In a first aspect, there is provided a method of driving an actuator, for a printhead, wherein the actuator comprises: an actuating element; an obturator assembly, engageable with the actuating element, the actuating element is operable to assume, depending on a drive signal applied thereto: a rest configuration, in which the obturator assembly is at a first distance from a reference plane; a first deformed configuration, in which the obturator assembly is at a second distance from the reference plane greater than the first distance; and a second deformed configuration, in which the obturator assembly is in contact with the reference plane; characterized in that the method comprises: supplying the drive signal during a first operating cycle to the actuating element to cause the obturator assembly to move between the rest configuration and the first deformed configuration.

Preferably, the method comprises supplying the drive signal to the element during a second operating cycle, to cause the actuating element to pass the rest configuration to the second deformed configuration.

Preferably, the actuator element is a piezoelectric element.

Preferably, the drive signal is provided as a voltage waveform.

Preferably, the drive signal comprises print data.

In a second aspect there is provided an actuator 1, for a printhead: wherein the actuator comprises: an actuating element an obturator assembly, engageable with the actuator element; wherein the actuating element is operable to assume, depending on a drive signal applied thereto: a rest configuration, in which the obturator assembly is at a first distance from a reference plane; a first deformed configuration, in which the obturator assembly is at a second distance from the reference plane greater than the first distance, and a second deformed configuration, in which the obturator assembly is in contact with the reference plane, wherein: a control module is configured for regulating a drive signal to the actuating element to cause the obturator assembly to move between the rest configuration and the first deformed configuration during a first operating cycle.

Preferably, the control module is configured for regulating the drive signal to cause the actuating element to pass the rest configuration to the second deformed configuration during a second operating cycle.

Preferably, the control module is configured for regulating the drive signal to cause the actuating element to pass the rest configuration to the second deformed configuration during a second operating cycle.

Preferably the drive signal relates to print data.

Preferably, the actuating element comprises at least one piezoelectric layer.

Preferably, the at least one piezoelectric layer is arranged as a bimorph.

Preferably, the actuating element comprises a plurality of piezoelectric layers, wherein the piezoelectric layers are operable to be controlled using a first voltage level applied to a first electrode associated with the plurality of layers; a second voltage level applied to a second electrode associated with the plurality of layers, and a third voltage level applied to a third electrode associated with the plurality of layers, and wherein the first voltage is higher than the second voltage and wherein the third voltage is controllable between the first and second voltage.

Preferably, the obturator assembly comprises a sealing surface operable to contact the reference plane in the second deformed configuration of the piezoelectric element.

In a third aspect there is provided a printhead comprising a nozzle inlet, a nozzle and a nozzle outlet, wherein the nozzle inlet is arranged on a stop surface arranged on the reference plane, and further comprising, an actuator, wherein the actuator comprises: an actuating element an obturator assembly, engageable with the actuator element; wherein the actuating element is operable to assume, depending on a drive signal applied thereto: a rest configuration, in which the obturator assembly is at a first distance from a reference plane; a first deformed configuration, in which the obturator assembly is at a second distance from the reference plane greater than the first distance, and a second deformed configuration, in which the obturator assembly is in contact with the reference plane, wherein: a control module is configured for regulating a drive signal to the actuating element to cause the obturator assembly to move between the rest configuration and the first deformed configuration during a first operating cycle.

Preferably, the first operating cycle is operable to generate at least one droplet from the nozzle outlet.

Preferably, the second operating cycle is operable to prevent droplet ejection from the nozzle outlet.

Preferably, wherein the fluid comprises glaze, or wherein the fluid comprises engobe.

In a fourth aspect there is provided a printhead using the above described method to generate at least one droplet.

In a fifth aspect there is provided a printer comprising the above described printhead.

In a sixth aspect there is provided a drive signal for driving an actuator for an inkjet printhead between X0 and X1.

Further characteristics and advantages of the present invention will appear more clearly from the detailed description which follows, illustrated by way of the non-limiting examples in the attached drawings, in which.

Figure 1:
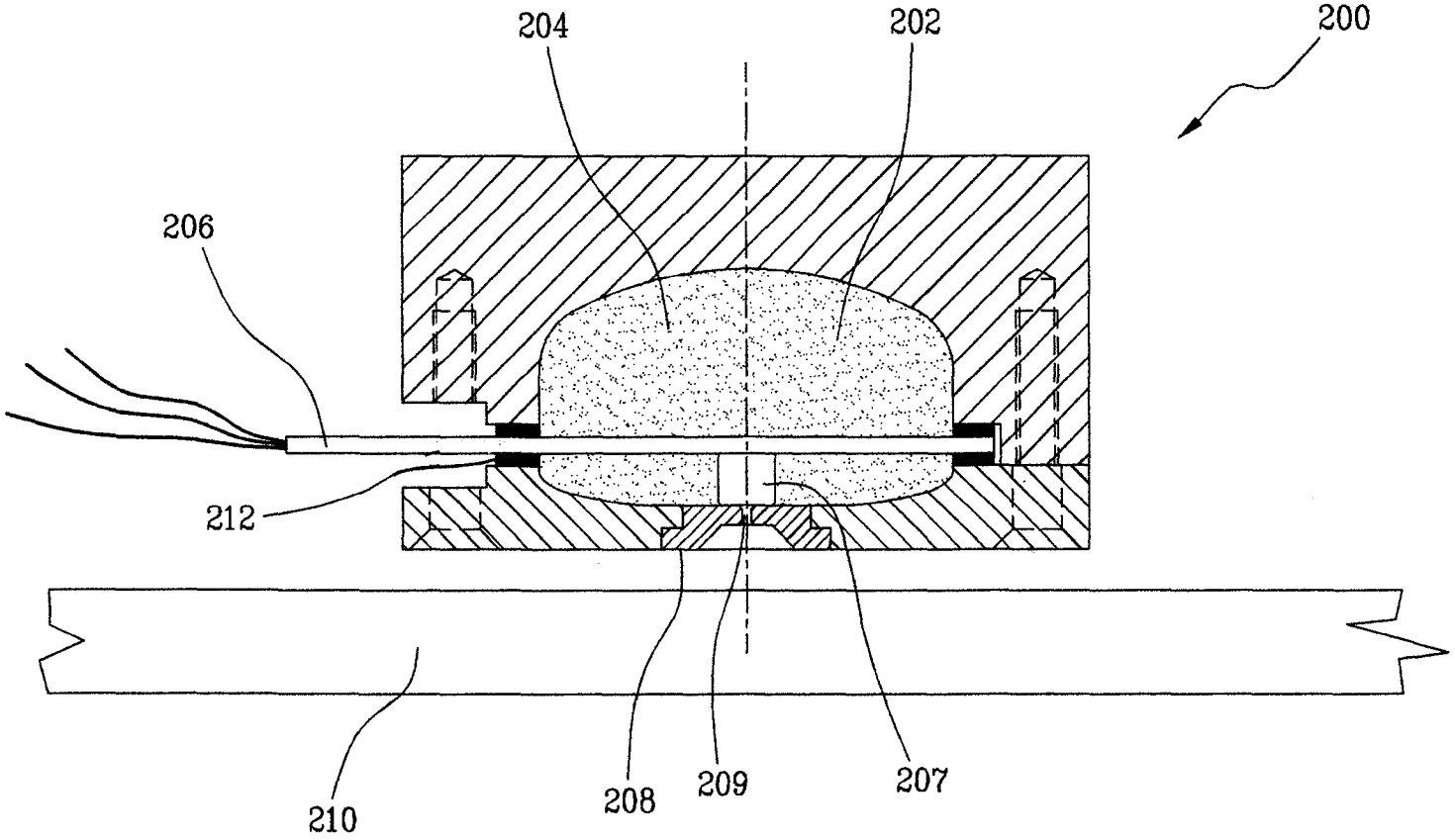
Figure 1 (Prior Art)
FIG. 1 shows in section an example of a conventional printhead of the prior art.
Figure 2:
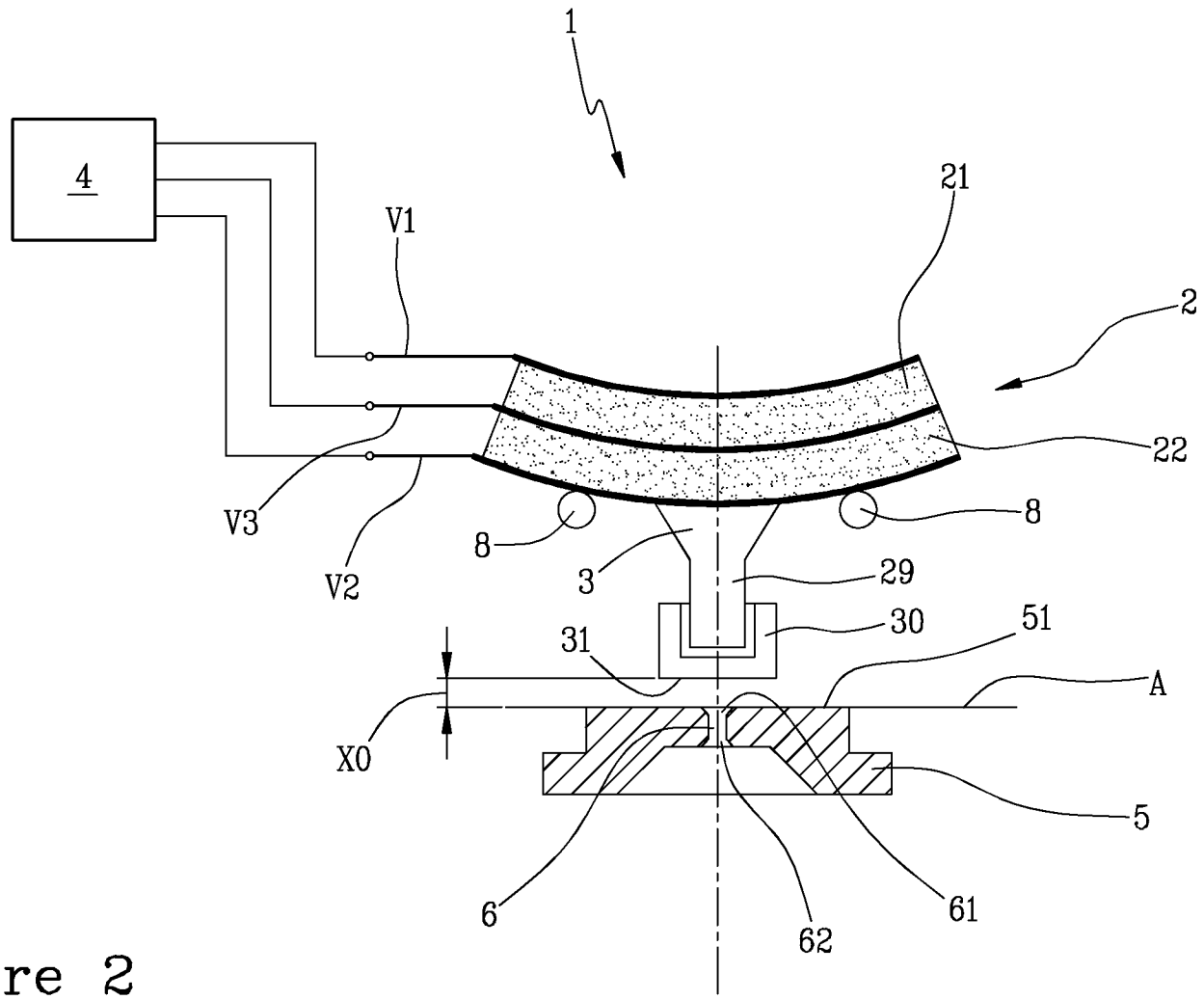
FIG. 2 shows a schematic view of an actuator according to a first embodiment of the present invention, in an initial configuration.
Figure 3:
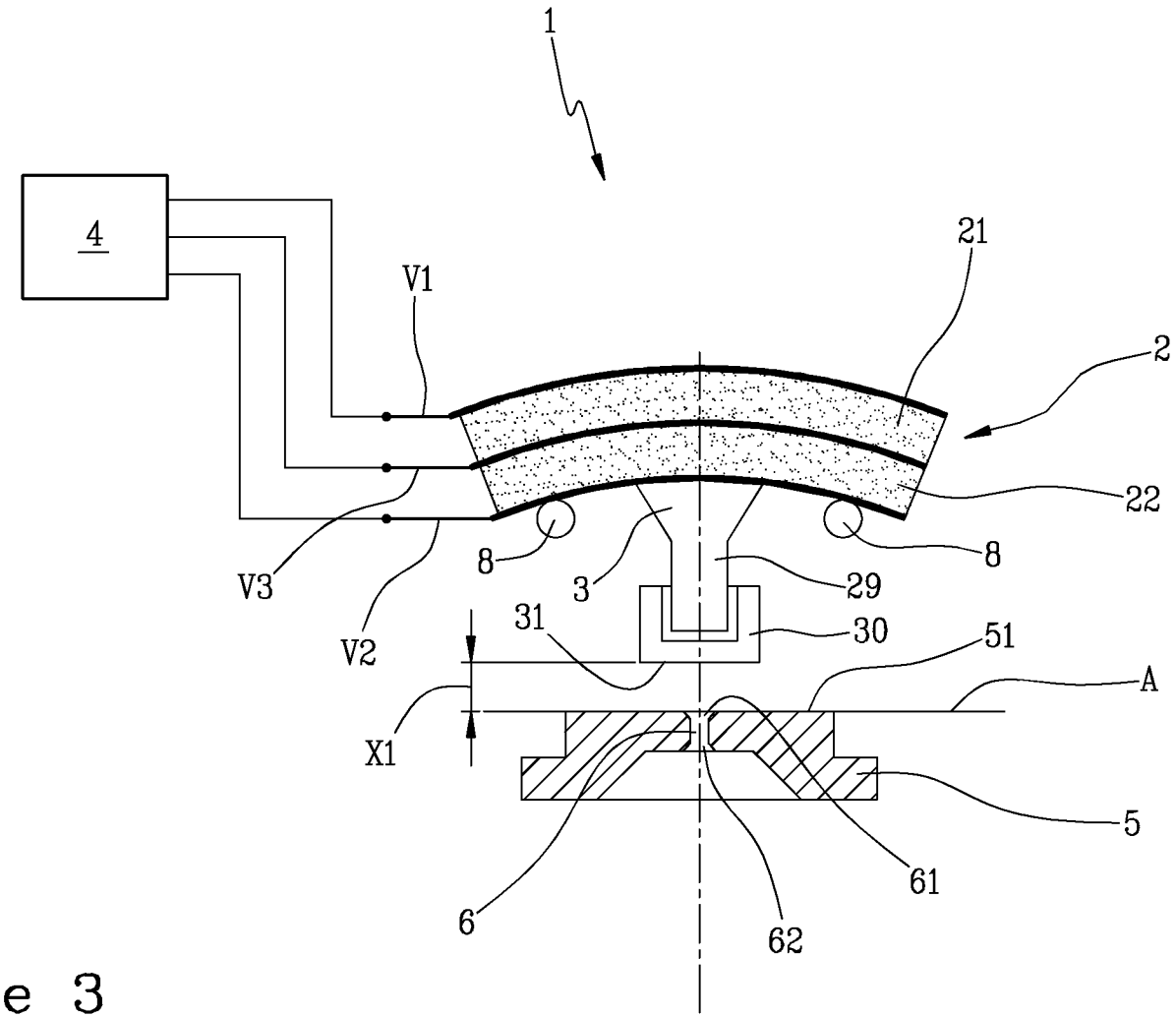
FIG. 3 shows a schematic view of the actuator of FIG. 2 in a first deformed configuration.
Figure 4:
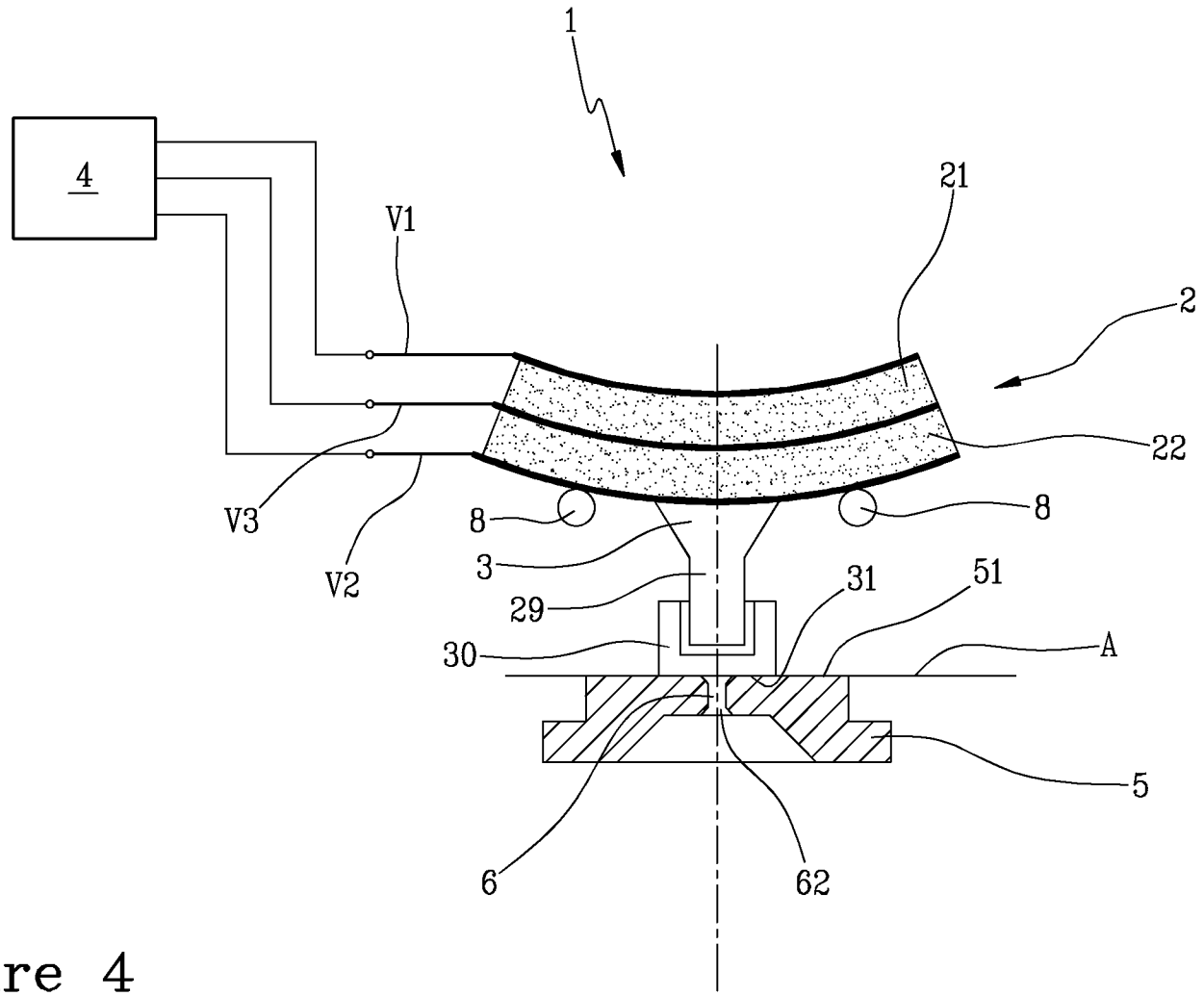
FIG. 4 shows a schematic view of the actuator of FIG. 2, in a second deformed configuration.
Figure 5A:
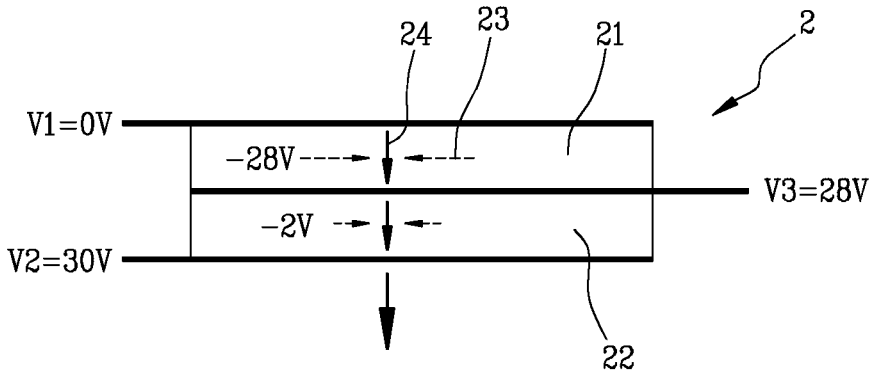
Figure 5B:
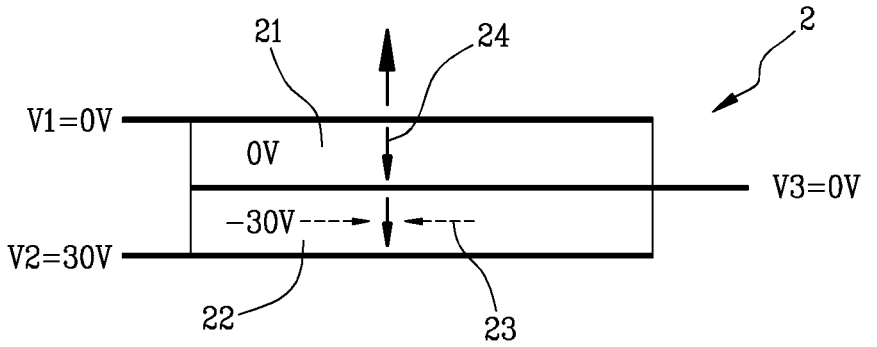
Figure 5C:
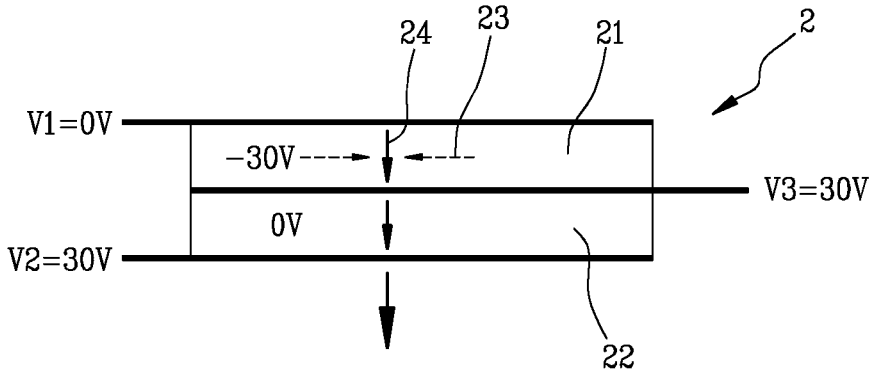
Figure 6:
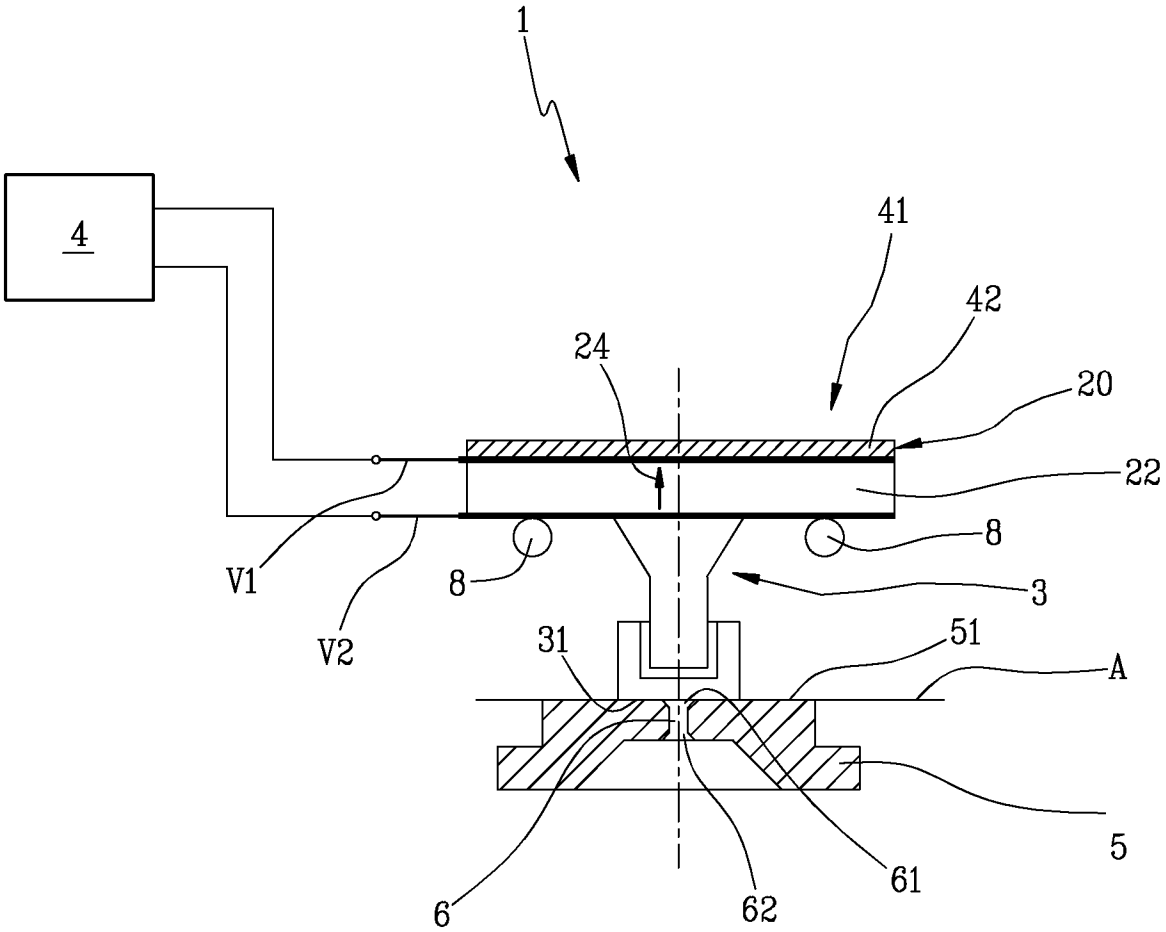
Figure 7:
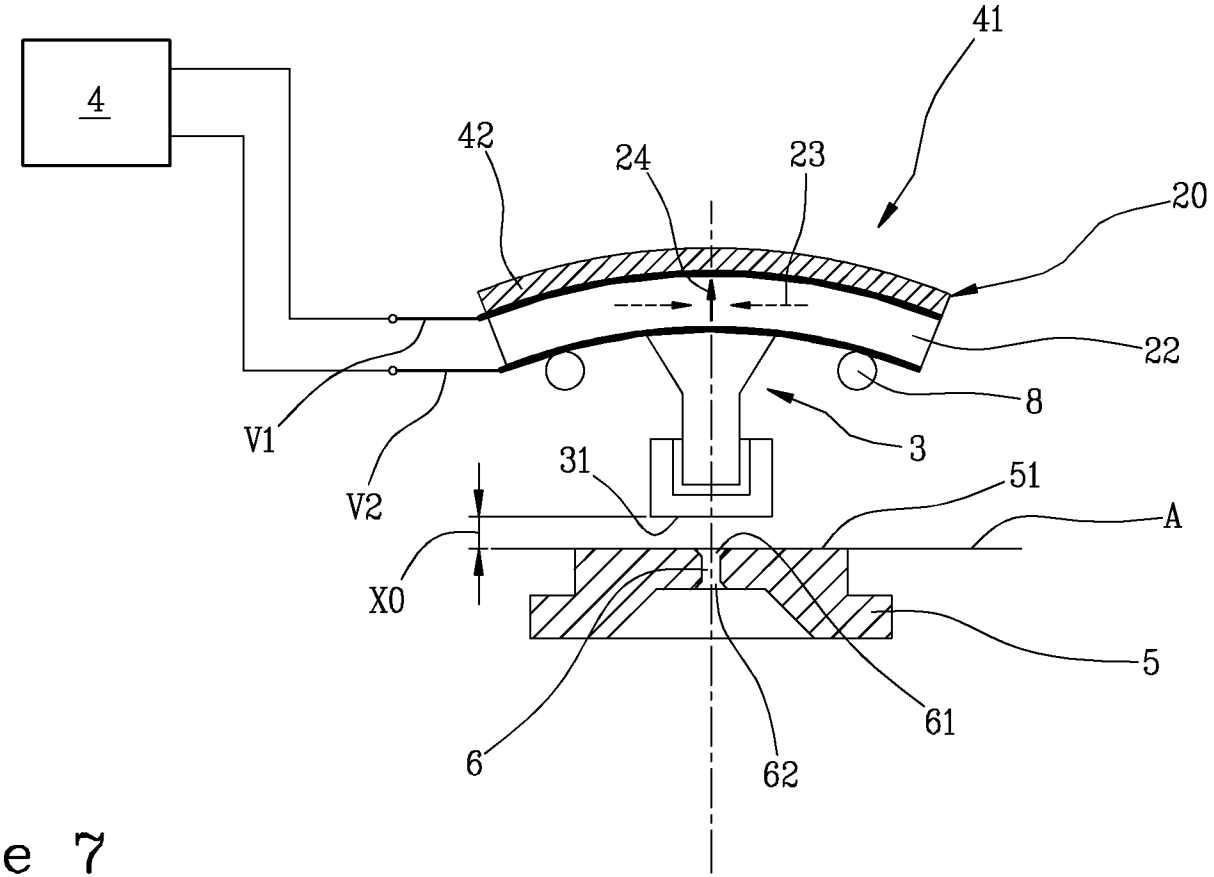
Figure 8:
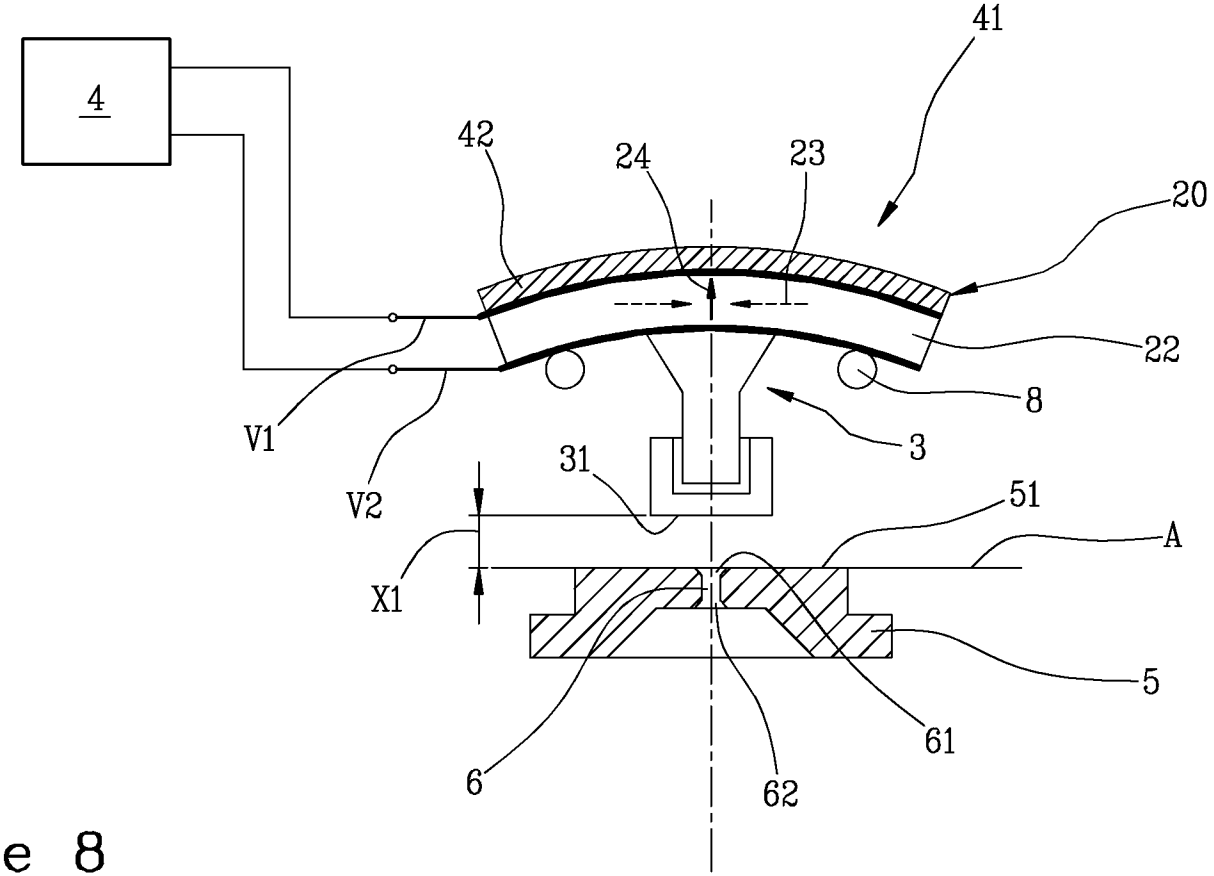
Figures 9A, 9B:
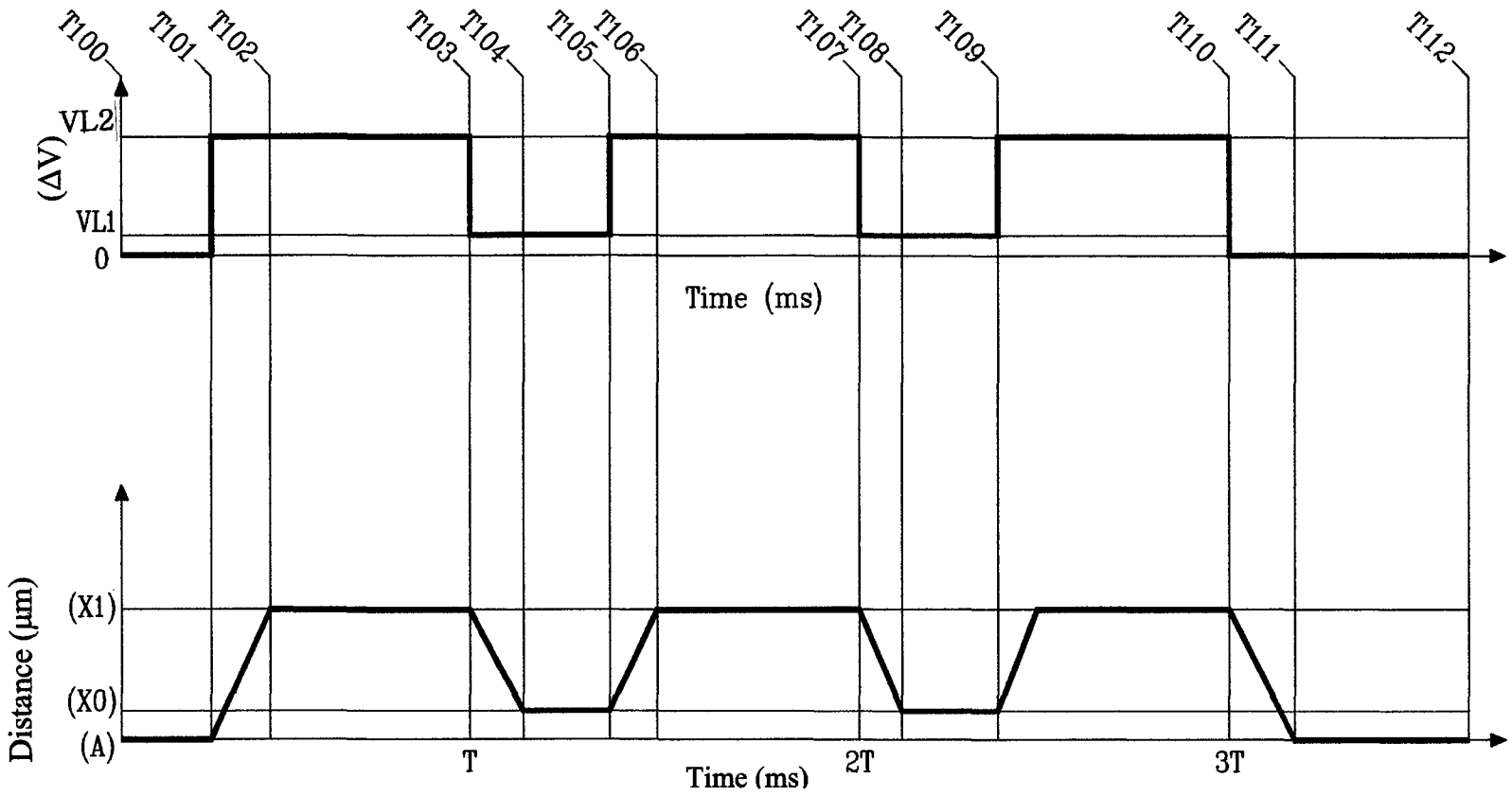

FIG. 5*a* is a schematic showing an example voltage differential between first, second and third electrodes of the actuator FIG. 2;

FIG. 5*b* is a schematic showing an example voltage differential between first, second and third electrodes of the actuator FIG. 3;

FIG. 5*c* is schematic showing an example voltage differential between first, second and third electrodes of the actuator FIG. 4;

FIG. 6 shows a schematic view of an actuator according to a second embodiment of the present invention, in an initial configuration;

FIG. 7 shows a schematic view of the actuator of FIG. 6 in a first deformed configuration;

FIG. 8 shows a schematic view of the actuator of FIG. 6, in a second deformed configuration;

FIG. 9*a* is an example waveform showing the voltage differential between two electrodes of the actuator of FIGS. 2 and 6;

FIG. 9*b* is an example waveform showing the separation gap between a surface of an obturator and a reference plane as result of actuation of the actuator of FIG. 6.

FIG. 10*a* is a schematic showing a piezoelectric stack actuator in a third embodiment of the present invention;

FIG. 10*b* is a schematic showing a piezoelectric stack actuator in the third embodiment of the present invention;

FIG. 10*c* is a schematic showing a piezoelectric stack actuator in the third embodiment of the present invention;

FIG. 11*a* is a schematic showing a piezoelectric stack actuator in a fourth embodiment of the present invention;

FIG. 11*b* is a schematic showing the piezoelectric stack actuator in the fourth embodiment of the present invention; and FIG. 11*c* is a schematic showing a piezoelectric stack actuator in the fourth embodiment of the present invention.

Referring to the figures in more detail and according to a first embodiment of the invention, FIG. 2 shows a schematic view of an actuator 1, in an initial/rest configuration; FIG. 3 shows a schematic view of the actuator 1 in a first deformed configuration; FIG. 4 shows a schematic view of the actuator 1, in a second deformed configuration. It will be noted that the term "initial configuration" is not limited to the actuator being in one of a deformed or non-deformed configuration.

The actuator 1 according to a preferred embodiment of the present invention comprises a piezoelectric element 2 formed, for example, of lead zirconate titanate (PZT), barium titanate, potassium sodium niobate (KNN) and/or bismuth sodium titanate (BNT) or any suitable material, which provides controlled deflection thereof on application of a drive signal thereto.

In a preferred embodiment, the piezoelectric element 2 is a substantially flat rectangular plate comprising one or more piezoelectric layers, configured to function as a bimorph, whereby the driving and contraction of the layer(s) creates a bending moment that converts a transversal change in length into a large bending displacement perpendicular to the contraction. Such functionality is obtained using known piezoelectric elements, for example, a PICMA® Bender Piezoelectric actuator (e.g. PL112-PL140), which allows for full differential control of the displacement. It will be appreciated that the shape of the element is not restricted to being a rectangular plate, but may be square, disc or any suitable shape.

In the preferred embodiment, at least one pair of poled piezoelectric layers 21, 22 are coupled to each other along the planar surfaces, whereby the two elements are mounted adjacent each other. The layers 21 and 22 are connected to three electrodes or terminals V1, V2 and V3 which are addressable by a user to supply a controllable drive signal to the piezoelectric element 2, for example, to provide a controllable voltage differential across the layers 21, 22.

Such a multilayer structure can effect bidirectional displacement, where one layer contracts whilst another layer contracts to a greater or lesser extent, expands or does not contract.

To drive this configuration and to effect deflection of the piezoelectric element, two electrodes V1 & V2 are provided on the two layers 21, 22, whilst a third electrode V3 is provided between the two layers 21 and 22. A control module 4 is used to supply a controllable drive signal to drive the electrodes e.g. to provide a controllable voltage differential (ΔV) across the electrodes.

The piezoelectric element 2 may also comprise more than one pair of poled piezoelectric elements arranged in a multilayer stack, for example as a block/ring type arrangement, whereby the multilayer stack of piezoelectric elements comprises interdigitated electrodes which are addressable individually or in groups by the control module 4 in order to drive pairs of bilayers simultaneously as shown in FIGS. 10*a*-10*c* and 11*a*-11*c* below.

In the present embodiment, the piezoelectric element 2 is located on retaining means 8, e.g. stainless steel pins, located towards each of its ends, such that the element is maintained in position thereon, such that it deflects in a concave and/or convex direction with respect to a reference plane A. However, such retaining pins may be replaced using any suitable mounting/retaining means e.g. a surface of a printhead in which the actuator is located, clamps, elastomeric mountings etc. As will be appreciated, a downward and/or side force may be applied on the piezoelectric element 2 to retain it in position relative to the retaining means 8.

For the present embodiment, when the actuator is used in a printhead, such as, for example, a conventional printhead 200, an obturator assembly 3 is attached to the piezoelectric element 2.

The obturator assembly 3 comprises a valve head 30 connected to the piezoelectric element 2 by a connecting element such as, for example, a connecting rod 29. It will be appreciated that it is advantageous for the valve head 30 and connecting rod 29 to be fabricated of a material which provides mechanical resistance to a fluid in contact therewith. Therefore, when using fluid such as glaze as described below, the valve head 30 is fabricated from materials such as NBR 70 Shore A or Titanium Grade 5 whilst the connecting rod 29 is formed of e.g. a thermoplastic polyetherimide (PEI) such as Ultem 1000.

A first end of the connecting rod 29 is secured to the piezoelectric element 2 using a suitable adhesive such as Loctite or an epoxy, whilst the distal end of the connecting rod 29 is inserted into the open end of the valve head 30 and secured therein using glue such as. Loctite or an epoxy. In an alternative embodiment the valve head is coupled directly to the piezoelectric element 2, without the need for a connecting rod 29.

The exterior of the valve head 30 comprises a substantially planar valve surface 31 at the second end, for example having a surface roughness ($R_a$) in the range of, for example, $R_a$=0.05-1 μm and preferably in the range of $R_a$=0.4-0.8 μm.

A control module 4 is configured for regulating the drive signal e.g. an electric field in the form of an applied voltage or voltage differential supplied to the piezoelectric element 2 so that it assumes an initial configuration, in which the obturator assembly 3 is at a first distance X0 from reference plane A as shown by FIG. 2 (i.e. at X0); a first deformed configuration, in which the obturator assembly 3 is at a second distance X1 from the reference plane A greater than the first distance X0 as shown by FIG. 3 (i.e. at X1); and a second deformed configuration, in which the obturator assembly 3 is in contact with the reference plane A as shown by FIG. 4 (i.e. at A).

It will be also be appreciated that X0 and X1 relate to the distance between reference plane A and the valve surface 31 of the obturator assembly 3. Furthermore, it will be appreciated that parts of the description describing the obturator assembly, piezoelectric element, or valve head being at X0 or X1 will be interpreted as meaning that the valve surface 31 is at a distance X0 or X1 from reference plane A respectively.

It will be seen in FIG. 2 that the piezoelectric element 2 is deformed when the obturator assembly 3 is at X0, but, as described previously, the piezoelectric element 2 may, in an alternative embodiment, be arranged to be non-deformed when the obturator assembly 3 is at X0.

For the embodiments below, it will be seen that in a first operating cycle, the control module 4 is configured to regulate the supply voltage to the piezoelectric element 2 in such a way as to cause the piezoelectric element 2 to repeatedly deflect between the initial configuration and the first deformed configuration as required, whereby such deflection from X1 to X0 effects droplet generation.

Furthermore, in a second operating cycle, the control module 4 is further configured to regulate the supply voltage to the piezoelectric element 2 so as to maintain the piezoelectric element 2 in the second deformed configuration.

The first and second operating cycles are extremely advantageous, particularly in that they allow for controlled deposition of droplets through a nozzle outlet, onto a substrate such as ceramic tiles. Such functionality is described below in greater detail.

Whilst the operation of the printhead is described hereinafter using glaze, it will be appreciated that any suitable fluid could be used depending on the specific application e.g. methyl ethyl ketone or acetone based ink for printing on cardboard/paper/food packaging, a polymer/metallic based ink for 3D-printing, engobe for printing on ceramics, or a food based fluid such as chocolate.

The glaze itself may contain pigment(s) to provide colour after firing, and/or comprise other additives such as clay, to provide different finishes such as glossy, matt, opaque finishes that may be combined on the same surface, as well as special effects such as metallic tones and lustre.

An example glaze composition suitable for digital printing is disclosed in ES2386267. Particle sizes within the glaze are generally in the range of between 0.1 μm-40 μm, but preferably up to 10 μm, and more preferably the glaze has a particle size distribution whereby $D_{90}$<6 μm.

Alternatively engobe may be used in the printhead, whereby, as will be appreciated by a person skilled in the art, engobe is used to provide a consistent clean canvass or profile on the surface of the tile.

Engobe is a clay particle suspension, whilst glaze generally comprises an aqueous or solvent based glass frit suspension, or a suspension within a solution, made up of a liquid part having a quantity of mineral particulates/powders dispersed therein, whereby the specific glaze formulation is dependent on the requirements of the end user. A glaze may also contain engobe.

The printhead comprises a fluid chamber, designed to contain the glaze to be deposited on a substrate, whereby the glaze is supplied to the chamber from a controlled glaze supply system via an inlet and an outlet at a pressure of e.g. 0.1 Bar-10 Bar, and preferably, wherein the pressure is preferably between 0.5 and 1.5 Bar, and preferably, whereby the pressure is substantially equal to 1 Bar.

The fluid chamber is provided with a nozzle portion 5, equipped with a through nozzle 6 which provides fluid communication between the fluid chamber and the exterior of the printhead, in order to permit the ejection of fluid from the fluid chamber, through a nozzle outlet 62, for deposition onto a substrate.

In general, the nozzle portion 5 refers to a part of the fluid chamber having at least one nozzle 6 formed therein. The nozzle portion 5 is formed of any suitable material having mechanical and chemical properties resistant to the fluids used in the particular printing applications required by a user e.g. PEEK (KETRON), PEI, Stainless Steel (LS316) or Silicon, whereby the nozzle 6 is formed therein by a suitable manufacturing technique e.g. by micro electrical discharge machining (EDM)/laser machining/chemical etching etc. The nozzle portion 5 may be formed integral to the fluid chamber during fabrication of the chamber, or may be a separate element which is assembled into the chamber during manufacture of the printhead, and secured in place using a suitable adhesive e.g. Loctite or an epoxy.

When printing with glaze or engobe the nozzle 6 preferably has a diameter between 300 μm-500 μm, and substantially between 375 μm-425 μm, and preferably substantially the diameter is substantially equal to 400 μm but, dependent on the specific application and/or the glaze or engobe used, the nozzle diameter may be in the range of 80 μm-1000 μm.

In the present embodiment, the nozzle 6 is provided with nozzle inlet 61 arranged on a stop surface 51, of the nozzle portion 5, whereby the inlet 61 has a wider diameter than the nozzle 6 e.g. 1000-2000 μm, and preferably ~1500 μm and, further preferably, which tapers, e.g. at a 60° slope, to the specific diameter of nozzle 6. Furthermore, in the present embodiment, the nozzle outlet 62 has a similar profile to the nozzle inlet 61 in that the outlet 62 has a wider diameter than the nozzle 6 e.g. 1000-2000 μm, and preferably ~1500 μm and which tapers, e.g. at a 60° slope to the specific diameter of nozzle 6. The stop surface 51 is located on the reference plane A.

It will be appreciated that the specific diameters and taper values of the nozzle inlet 61, outlet 62 and nozzle 6 will vary depending on the specific application and/or glaze used.

It is known that a taper on the nozzle outlet 62 effects wetting at the surface adjacent the nozzle, and, therefore, affects droplet generation, whilst a taper at the nozzle inlet 61 improves fluid flow into the nozzle 6. However, depending on the application, the specific angle of the taper at either the nozzle inlet 61 or nozzle outlet 62 may be reduced, or removed altogether, as will be appreciated by a person skilled in the art. There is no requirement that the diameters and tapers of the nozzle inlet 61 and nozzle outlet 62 are the same although in some instances this may be the case The piezoelectric element 2 according to the present invention is arranged inside the printhead such that, in the second deformed configuration, the valve surface 31 of the obturator assembly 3 is forced into contact with stop surface 51 of the nozzle portion 5 and arranged to substantially seal the nozzle inlet 61.

In the present embodiment, the valve head 30 is formed of a cylindrical tube shaped component having an inner diameter of approximately 1.9 mm and an outer diameter of approximately 4 mm.

However, it will be appreciated that the diameter of the valve head 30 is not limited to an outer diameter in the millimeter range, but it will at least be equal to the diameter of the nozzle inlet 61, and will preferably be larger than the diameter of the nozzle inlet 61.

Furthermore, there is no requirement for the valve head 30 to be cylindrical but it will be appreciated that the valve surface 31 thereof will extend sufficiently to cover the nozzle inlet 61 when the piezoelectric element 2 is in the second deformed configuration (FIG. 4).

Therefore, when the valve surface 31 is in contact with the stop surface 51 of the nozzle portion 5, a mechanical seal/obstruction is provided around the nozzle inlet 61 such that fluid is prevented/restricted from entering the nozzle 6 through the nozzle inlet 61.

In all described embodiments the valve surface 31 is substantially planar, and positioned parallel relative to the reference plane A, however it will be appreciated that the valve surface 31 is not limited to being flat and in alternative embodiments may be concave/convex/pyramidal etc. but, in any configuration, the valve surface 31 should be shaped to prevent/restrict the flow of glaze into the nozzle inlet 61 whilst in contact with stop surface 51.

During the first operating cycle, the piezoelectric element 2 is driven such that it deflects in bending mode from the initial configuration (FIG. 2) to the first deformed configuration (FIG. 3) and back to the initial configuration (FIG. 2) by means of the drive signal regulation performed by the control module 4. The operating cycle may be repeated such that the piezoelectric element 2 oscillates at a frequency of, for example, between 0.1 kHz to 10 kHz and preferably in the range of 0.8 kHz to 1.2 kHz, and further preferably at 1 kHz.

As described above, the oscillation of the piezoelectric element 2 in the first operating cycle effects a corresponding movement of the obturator assembly 3 coupled thereto, at the same frequency, between X0 and X1. whereby the movement of the obturator assembly 3 between X0 and X1 effects ejection of the fluid from the nozzle 5 as discussed below.

It will be appreciated that during the first operating cycle, a separation gap of at least X0 between surfaces 31 and 51 is present. Therefore, in contrast to conventional printheads, the valve surface 31 does not physically contact the stop surface 51 during drop ejection from the nozzle outlet 62.

In the present embodiment, the distance X0 is substantially equal to 2 μm, but any suitable value may be used for example between 0.1 μm and 25 μm, and preferably between 1 μm and 3 μm, which ensures that fluid flow is prevented or substantially restricted from flowing into the nozzle 6 when the valve surface 31 is at the distance X0.

It will be appreciated that because there is no impact between the valve head 30 and the stop surface 51 during drop ejection from the nozzle outlet 62, such functionality reduces the effects caused by frictional wear/impact between the valve surface 31 and/or the nozzle portion 5.

It will be appreciated that the drive signal may comprise print data, which relates to when drops should be ejected from the printhead (i.e. when pixels are required to be printed on a substrate), and when drops should not be ejected from the printhead (i.e. when no pixel is required to be printed on a substrate). The print data may be sent to the control module 4 via a computer, whereby the control module provides the corresponding drive signal to the actuator, as is known in the art.

The first operating cycle is preferably used repeatedly between adjacent pixels that are to be printed, i.e. for which print data is present and droplets are required to be ejected.

Where no droplets are required to be ejected, for example at the end of a print run, the second operating cycle is provided for as long as a droplet is not required to be ejected i.e. no pixel is required to be printed on a substrate.

In the second operating cycle, the control module 4 regulates the drive signal such that the piezoelectric element 2 assumes the second deformed configuration. In the second deformed configuration the valve surface 31 of the obturator assembly 3 is located in contact with the stop surface 51 of the nozzle portion 5, thereby substantially sealing the nozzle inlet 61.

Since contact between the valve head 30 and the nozzle portion 5 only occurs when a drop is not required, the wear between the obturator assembly 3 and the nozzle portion 5 is reduced significantly in comparison to conventional printheads, and the probability of damage to the obturator assembly 3 and/or nozzle portion and/or nozzle thereby compromising the closure of the nozzle is reduced, even after repeated operating cycles of the piezoelectric element 2.

One example of a driving strategy for the operating cycles described in FIGS. 2-4 is demonstrated in FIGS. 5*a*, 5*b* and 5*c*, which demonstrate examples of the drive signal applied as a voltage differential across the electrodes of the piezoelectric element 2 in order to achieve the particular displacement of the piezoelectric element 2. The layers 21 and 22 are poled in the same direction as indicated by the poling direction arrows 24.

When the voltage differential across the layers of the piezoelectric element 2 is substantially equal to 0V, the piezoelectric element 2 is in a non-deformed configuration, such that the valve surface 31 is positioned between X0 and X1 from the stop surface 51.

For the first operating cycle, the piezoelectric element 2 is initially deflected to the initial configuration such that the valve surface 31 is at X0 which, in the present embodiment, is substantially equal to 2 μm from the stop surface 51. Such a configuration is obtained by applying a voltage differential of approximately −28V DC across V1 and V3, thereby causing the piezoelectric layer 21 to contract in a direction indicated by the arrows 23 in FIG. 5*a*, whilst simultaneously applying a voltage differential of approximately −2V across V3 and V2, such that the layer 22 contracts to a lesser extent than layer 21. As a result of the greater contraction of layer 21, the bimorph piezoelectric element 2 deforms such that the obturator assembly is at X0 (FIG. 2).

The piezoelectric element 2 is subsequently deflected to the first deformed configuration such that the valve surface 31 is at X1, which, in the present embodiment, is substantially equal to 30 μm from the stop surface 51.

This configuration is obtained, for example, by applying a voltage differential of approximately 0V across V1 and V3, such that the layer 21 does not deform, whilst simultaneously applying a voltage differential of approximately −30V across V3 and V2, such that the layer 22 contracts in a direction indicated by the arrows 23 in FIG. 5*b*. As a result of the contraction of layer 22, the bimorph piezoelectric element deforms such that the obturator assembly 3 is in the first deformed configuration i.e. at X1 (FIG. 3).

To complete the first operating cycle, the piezoelectric element is deflected back to the initial configuration as described above i.e. such that the obturator assembly is at X0.

Glaze flows through the nozzle inlet 61 into the nozzle 6 during the period the piezoelectric element 2 is in the first deformed configuration i.e. when the valve surface 3 is at X1 and continues flowing into the nozzle inlet 61 until the nozzle 6 fills or until the gap between the valve surface 31 and stop surface 51 reduces to a sufficient distance which prevents/substantially restricts the flow of glaze into the nozzle inlet 61 to fill the nozzle 6 i.e. when the valve surface 31 is substantially at X0.

Driving the piezoelectric element 2 using the waveform to drive the valve surface between X0 and X1 effects ejection of a droplet from the nozzle 6 for example as a pixel deposited on a substrate.

If a further droplet is required to be ejected from the nozzle 6 to a surface of a substrate for example if a further pixel is required to be deposited on a substrate, then the same first operating cycle, or a variation thereof, is repeated i.e. the piezoelectric element 2 is caused to deflect between X0 and X1. Such functionality, regulated by the control module 4, can be provided to the control module 4 as a waveform or program instructions via a communications network (e.g. the internet), a storage medium, or via computer terminal connected to the control module, or by any other suitable means.

The distance X0 at which glaze is prevented/substantially restricted from flowing into the nozzle inlet 61 is dependent on such factors including pressure in the chamber; the distance the valve surface 31 extends outwards over the circumference of the nozzle inlet 61; the time the valve surface 31 is separated from the stop surface 51 at a distance sufficient for fluid to flow into the nozzle 6, through the nozzle inlet 61; and the specific glaze properties.

Therefore, X0 is determined by the glaze being used in the printhead, the flow restrictions posed by the nozzle and the valve head diameter defining the valve surface 31. However, it will be appreciated that the pressure of the fluid inside the fluid chamber will affect the minimum separation gap for X0 whereby increasing the pressure in the chamber will effect/increase the flow of glaze through the inlet 61 for a certain gap.

Furthermore, the distance that the valve surface 31 extends outwards with respect to the nozzle inlet 61 also affects the flow of glaze into the nozzle inlet 61, such that increasing the distance that the valve surface 31 extends over the nozzle inlet 61 will decrease the flow of glaze into the nozzle inlet 61.

The distance X0 can therefore be set depending on the particular fluid and/or with respect to particular system parameters and can be varied depending on the drive signal. A one-off trim or an active system measuring every (or multiple) actuations could be used to ensure that the correct deflection to X0, X1 and stop surface 51 is substantially obtained and maintained by the actuator 1. It will be appreciated that for all embodiments herein described, the distances X0 and X1 may vary e.g. by ±50%, but preferably less than ±10% due to e.g. operating conditions of the printhead, tolerances in actuator and/or the applied drive signal.

If drop ejection is not required, i.e. if no pixel is required to be deposited on a substrate, the piezoelectric element 2 is deflected to the second deformed configuration whereby the valve surface 31 is in contact with the stop surface 51.

The second deformed configuration, as illustrated in FIG. 5*c*, is obtained by applying a voltage differential of e.g. approximately −30V across V1 and V3, such that the layer 21 contracts in a direction indicated by the arrows 23, whilst simultaneously applying a voltage differential e.g. approximately 0V across V3 and V2, such that the layer 22 does not deform. As a result of the contraction of layer 21, the piezoelectric element deforms such that the piezoelectric element 2 is in the second deformed configuration, such that the valve surface 31 is forced into contact with the stop surface 51, thereby sealing/restricting flow into the nozzle inlet 61 such that glaze is prevented/substantially restricted from flowing into the nozzle 6.

It will be appreciated that the volume of the ejected droplet is defined by the volume of fluid in the nozzle at the time the drop is ejected. It will be appreciated that the volume of the fluid in the nozzle is dependent on a number of factors including the nozzle geometry; pressure in the chamber; the distance the valve surface 31 extends outwards relative to the diameter of the nozzle inlet 61; and/or the time the valve surface 31 is separated from the reference plane A at a distance sufficient for fluid to flow into the nozzle 6, through the nozzle inlet 61. During typical operation, the pressure is preferably maintained constant in the fluid chamber e.g. between 0.5 Bar-3 Bar, and preferably at substantially 1 Bar, whilst the geometry of the nozzle and valve head are constant.

Therefore, it will be appreciated that controlling the first and second operating cycles allows the user to control the volume of fluid in the nozzle 6, and, therefore, the drop size of the ejected drop from the nozzle 6. Therefore, variable drop sizes can be achieved by varying the drive waveform. The maximum volume of fluid in the nozzle 6 is achieved when the fluid meniscus inside the nozzle reaches the nozzle outlet 62 and before wetting occurs on the exterior of the printhead.

Whilst in the embodiment described above, the actuator 1 is described as a multilayer piezoelectric element 2 comprising at least one pair of piezoelectric layers 21 & 22, in a second embodiment as shown in FIGS. 6 to 8, there is described an actuator 41 having a single layer 22 piezoelectric element 20, coupled to a rigid substrate layer 42 e.g. ceramics ($Al_2O_3$) or stainless steel layer using a suitable adhesive such as Loctite or epoxy. Like numbering will be used for like elements described above in the first embodiment.

Therefore, referring to FIGS. 6 to 8, the rigid substrate layer 42 provides bimorph functionality to the piezoelectric element 20, whereby when the piezoelectric layer 22 contracts or expands, the piezoelectric element 20 deforms in a concave or convex direction relative to the stop surface 51 on reference plane A. The direction of poling of the layer 22 is represented by the arrow 24, whilst the direction of the contraction/expansion is represented by the arrow 23 (not shown in FIG. 6).

The valve surface 31 of the obturator assembly 3 attached to the piezoelectric element 20 is located on the stop surface 51 when the actuator 41 is at an initial configuration (FIG. 6). It will be seen that the initial configuration of the present embodiment is different to the actuator 1 of the first embodiment in that the piezoelectric element 20 is not deformed.

Electrodes V1 and V2 are provided on the piezoelectric element 20, and the piezoelectric element 20 is configured such that the piezoelectric element 20 is operable to deflect to a first deformed configuration such that the valve surface 31 is at a distance X0 from the stop surface 51, whereby in this embodiment X0 is substantially equal to 2 μm (FIG. 7), and whereby the piezoelectric element 20 is operable to further deflect to a second deformed configuration such that the valve surface 31 is at a distance X1 from the stop surface 51 whereby in this embodiment X1 is substantially equal to 30 μm (FIG. 8), and to oscillate between X0 and X1.

As described above with respect to the first embodiment, when the actuator 41 is used as an actuator in a printhead, and when drop ejection from the nozzle outlet 62 is required, the piezoelectric element 20 is deflected such that the valve surface 31 deflects between X0 and X1, whilst the piezoelectric element 20 is deflected to the second deformed configuration when a drop is not required to be printed.

FIG. 9*a* shows an example waveform for driving the piezoelectric element 20, with a voltage differential (ΔV) between 0V, VL1 and VL2, whilst FIG. 9*b* is an example waveform showing the separation gap between a valve surface 31 and a stop surface 51/reference plane A as result of actuation of the piezoelectric element 20.

At (T101) the voltage differential across the electrodes V1 and V2 is increased from 0 to VL2, such that the piezoelectric element 20 deflects such that the valve surface 31 moves from stop surface 51 to X1, and at (T103) the voltage differential is reduced from VL2 to VL1 such that the valve surface 31 moves from X1 to X0. In the present embodiment VL1 may be, for example, substantially equal to 2V, whilst VL2 may be substantially equal to 30V. Furthermore, in the present embodiment X0 is substantially equal to 2 μm, whereas X1 is substantially equal to 30 μm.

As will be appreciated, deflection of the piezoelectric element 20 between X0 and X1 results in drop ejection from the nozzle 6 onto a substrate.

When drop ejection is not required, the voltage differential (ΔV) is reduced to substantially 0V across the piezoelectric element 20 such that the obturator 3 returns to the initial configuration (e.g. at T110), whereby the valve surface 31 is in contact with stop surface 51 such that it prevents the flow of glaze into the nozzle 6 through the nozzle inlet 61.

In the present embodiment, the frequency e.g. between T and 2T is substantially equal to 1 kHz, but the drive waveform may be adjusted according to specific user requirements. For example, if increased drop ejection is required, then the frequency of the waveform is increased accordingly.

As will be appreciated, a similar drive waveform as described in FIGS. 9*a* and 9*b* for piezoelectric element 20 may be used to drive the piezoelectric element 2. Using a piezoelectric element 2 comprising two layers requires less voltage in comparison to the piezoelectric element 20 having only a single layer, but both piezoelectric elements 2 and 20 are operable to provide similar functionality.

As briefly discussed above it will be appreciated that multi-layered piezoelectric stacks could be used to provide the actuator functionality outlined above.

The stacks comprise multiple poled piezoelectric layers coupled together each having first and/or second and/or third electrodes associated therewith, whereby the layers are operable to contract or expand depending on the electric field e.g. voltage differential (ΔV) across the electrodes, whereby the expansion or contraction is dependent on the direction of the electric field and the direction of poling. Driving multistacks of piezoelectric layers using drive signals e.g. voltage waveforms will be readily known by persons skilled in the art.

In a further embodiment as shown in FIGS. 10*a*-10*c*, piezoelectric element 70 is formed of individual piezoelectric layers 71-76 securely coupled to each other in a stack arrangement e.g. as a stack of individual piezoelectric layers, whereby adjacently coupled layers are oppositely poled, as indicated by poling arrows 77.

The piezoelectric element 70 has interdigitated electrodes V1, V2 and V3, whereby layers 71, 72 and 73 are each electrically connected to electrode V1, layers 74, 75 and 76 are each electrically connected to electrode V2, whilst all layers 71-76 are each electrically connected to V3.

The piezoelectric element 70 can be driven to provide the functionality described in FIGS. 2-4 above in a printhead for controlled ejection of droplets therefrom, whereby the piezoelectric element 2 is replaced by piezoelectric element 70. Like numbering will be used for like elements described above.

The control module 4 is configured for regulating the drive signal e.g. print data in the form of an applied voltage or voltage differential (ΔV) on the piezoelectric element 70 such that it assumes one of an initial configuration, in which the obturator assembly 3/valve surface 31 is at a distance X0 from a stop surface 51 as shown by FIG. 2 (above), a first deformed configuration, in which the obturator assembly 3/valve surface 31 is at a distance X1 from stop surface, whereby the distance X1 is greater than the distance X0 as shown by FIG. 3 above, and a second deformed configuration, in which the obturator assembly 3/valve surface 31 is forced into contact with the stop surface 51 as shown by FIG. 4 above.

When the voltage differential (ΔV) across all layers of the piezoelectric element 70 is substantially equal, the piezoelectric element 70 is in a non-deformed configuration.

For the first operating cycle, the piezoelectric element 70 is initially deflected to the initial configuration such that the valve surface 31 is at X0, which, in the present embodiment, is substantially equal to 2 μm from the stop surface 51.

Such a configuration is obtained by applying, for example, a voltage substantially equal to 30V to V1, 0V to V2 and 28V to V3, such that the voltage differentials of approximately 2V, −2V and 2V are provided across layers 71 to 73 respectively, and approximately 28V, −28V and 28V across layers 74-76 respectively result in the piezoelectric layers 71-76 contracting and expanding substantially in the directions indicated by the contraction arrows 79 and expansion arrows 80 in FIG. 10*a*. As a result of the substantially simultaneous contraction of layers 71-73 and expansion of layers 74-76, the bimorph piezoelectric element 70 deforms in a convex direction relative to the reference plane A, such that obturator assembly 3 is deflected substantially vertically downwards such that the valve surface 31 is at a distance X0 from the stop surface 51.

The piezoelectric element 70 is subsequently deflected to the first deformed configuration such that the valve surface 31 is at X1 which, in the present embodiment, is substantially equal to 30 μm from the stop surface 51.

This configuration is obtained by applying, for example, a voltage substantially equal to −30V to V1, whilst simultaneously applying approximately 0V to V2 and V3, such that the voltage differentials of approximately −30V, 30V and −30V across layers 71 to 73 respectively results in expansion of those layers substantially in the direction as indicated by the expansion arrows 80 in FIG. 10*b*, whilst layers 74 to 76 do not deform due to the zero voltage differential there across. As a result of the expansion of layers 71-73, and the non-deformation of layers 74-76, the bimorph piezoelectric element 70 deforms in a concave direction relative to the reference plane A, such that obturator assembly 3 is deflected substantially vertically upwards such that the valve surface 31 is at a distance X1 from the stop surface 51.

To complete the first operating cycle, the piezoelectric element is deflected back to the initial configuration as described above in relation to FIG. 10*a*.

To provide the functionality of the second operating cycle, e.g. when a drop is not required to be ejected from a printhead, the piezoelectric element 70 is deflected to the second deformed configuration.

This configuration is obtained by applying, for example, a voltage substantially equal to 30V to V1 and V3, whilst simultaneously applying approximately 0V to V2, such that the voltage differentials of approximately 0V across layers 71 to 73 respectively results in non-deformation of those layers, whilst the voltage differentials of approximately 30V, −30V and 30V across layers 74-76 respectively results in the expansion of those layers substantially in the direction as indicated by the expansion arrows 80 in FIG. 10*c*.

As a result of the expansion of layers 74-76, and the non-deformation of layers 71-73, the bimorph piezoelectric element 70 deforms in a convex direction relative to the reference plane A, such that obturator assembly 3 is deflected substantially vertically downwards to the second deformed configuration, such that the valve surface 31 is forced into contact with the stop surface 51, thereby substantially sealing the nozzle inlet 61 such that glaze cannot flow into the nozzle 6.

Whilst, the embodiment above describing the multistacks requires individual control of the electrodes V1, V2 and V3, FIGS. 11*a*-11*c*, describe, in a fourth embodiment, the piezoelectric element 170 formed of individual piezoelectric layers 171-176 securely coupled to each other in a stack arrangement. Adjacent layers 171 & 172 and adjacent layers 175 & 176 are oppositely poled, as indicated by poling arrows 177. Furthermore, adjacent layers 173 & 174, coupled between layers 171 & 172 and 175 & 176 respectively, are poled in the same direction as each other, but oppositely poled to the layers adjacent thereto i.e. 172 and 175 respectively.

The piezoelectric element 170 of FIGS. 11*a*-11*c* has interdigitated electrodes V1, V2 and V3, whereby layers 171, 172 and 173 are each electrically connected to electrode V1, layers 174, 175 and 176 are each electrically connected to electrode V2, whilst all layers 171-176 are electrically connected to V3.

The piezoelectric element 170 can be driven to provide the functionality described above in FIGS. 2-4 above for controlled ejection of droplets, whereby the piezoelectric elements 2 is replaced by piezoelectric element 170. Like numbering will be used for like elements described above.

The control module 4 is configured for regulating the drive signal e.g. print data in the form of a voltage or voltage differential (ΔV) supplied to the piezoelectric element 170 such that it assumes one of an initial configuration, in which the obturator assembly 3/valve surface 31 is at a distance X0 from stop surface 51 as shown by FIG. 2 (above); a first deformed configuration, in which the obturator assembly 3/valve surface 31 is at a distance X1 from nozzle inlet 61 on stop surface 51 located on the reference plane A, whereby the distance X1 is greater than the distance X0 as shown by FIG. 3 above; or a second deformed configuration, in which the obturator assembly 3/valve surface 31 is forced into contact with the stop surface 51 as shown by FIG. 4 above.

When the voltage differential (AV) across all layers of the piezoelectric element 170 is substantially equal, the piezoelectric element 170 is in a non-deformed configuration.

For the first operating cycle, the piezoelectric element 170 is initially deflected to the initial configuration such that the valve surface 31 is at X0, which, in the present embodiment, is substantially equal to 2 μm from the stop surface 51.

Such a configuration is obtained by applying, for example, a voltage substantially equal to 0V to V1, 30V to V2 and 28V to V3, such that the voltage differentials of approximately −28V, +28V and −28V across layers 171 to 173 respectively, and approximately −2V, +2V and −28V across layers 174-176 respectively result in the piezoelectric layers 171-176 contracting substantially in the directions indicated by the contraction arrows 179 in FIG. 11*a*. The contraction of layers 171-173 is much greater than that of layers 174-176, and as a result, the bimorph piezoelectric element 170 deforms in a convex direction relative to the reference plane A, such that obturator assembly 3 is deflected substantially vertically downwards such that the valve surface 31 is at a distance X0 from the stop surface 51.

The piezoelectric element 170 is subsequently deflected to the first deformed configuration such that the valve surface 31 is at X1 which, in the present embodiment, is substantially equal to 30 μm from the stop surface 51.

This configuration is obtained by applying, for example, a voltage substantially equal to 30V to V2, whilst simultaneously applying approximately 0V to V1 and V3, such that the voltage differentials of approximately −30V, 30V and −30V across layers 174 to 176 respectively results in contraction of those layers substantially in the direction as indicated by the contraction arrows 179 in FIG. 11*b*.

As a result of the contraction of layers 174-176, and the non-deformation of layers 171-173, the bimorph piezoelectric element 170 deforms in a concave direction relative to the reference plane A, such that obturator assembly 3 is deflected substantially vertically upwards such that the valve surface 31 is at a distance X1 from the stop surface 51.

To complete the first operating cycle, the piezoelectric element is deflected back to the initial configuration as described above in relation to FIG. 11*a* i.e. the obturator assembly is at X0.

To provide the functionality of the second operating cycle, e.g. when a drop is not required to be ejected from a printhead, the piezoelectric element 170 is deflected to the second deformed configuration.

This configuration is obtained by applying, for example, a voltage substantially equal to 30V to V2 and V3, whilst simultaneously applying approximately 0V to V1, such that the voltage differential of approximately 0V across layers 174 to 176 respectively results in non-deformation of those layers, whilst the voltage differentials of approximately −30V, 30V and −30V across layers 171-173 respectively results in the contraction of those layers substantially in the direction as indicated by the contraction arrows 179 in FIG. 11*c*.

As a result of the contraction of layers 171-173, and the non-deformation of layers 174-176, the bimorph piezoelectric element 170 deforms in a convex direction relative to the reference plane A, such that obturator assembly 3 is deflected substantially vertically downwards to the second deformed configuration, such that the valve surface 31 is forced into contact with the stop surface 51, thereby substantially sealing the nozzle inlet 61 such that glaze cannot flow into the nozzle 6.

The advantage of the latter embodiment is that the voltage applied to electrodes V1 and V2 can be maintained substantially constant, whilst deflection of the piezoelectric element 170 can be controlled by varying the drive signal applied to the common electrode V3, thereby reducing the complexity of the required drive circuitry and waveform/drive signals. As such, multiple actuators in a printhead may be controlled simultaneously with a simple control circuit compared to previous embodiments whereby the electrodes V1 and V2 of the actuators are connected to common rails, whilst the V3 electrode of each of the actuators is independently controllable by a control module e.g. to control drop ejection from each of the nozzles.

As will be appreciated, the piezoelectric elements 70, 170 can also be driven to provide the functionality described in FIGS. 6-8 above in a printhead for controlled ejection of droplets therefrom, whereby the piezoelectric element 20 is replaced by piezoelectric element 70 or 170.

Furthermore, as will be appreciated by the skilled person having taken the above description into account, the operating cycles may be altered to provide any desired functionality, or additional operating cycles may be provided to drive the piezoelectric elements as required for a particular application.

Furthermore, the values used for the above embodiments take the displacement of the piezoelectric elements 2, 20, 70, and 170 to be proportional to variations in the applied electric field (voltage/voltage differential), whereby the piezoelectric element provides approximately 1 μm displacement per 1V such that there is a substantially linear relationship between displacement (μm) and voltage applied (V)), but, as will be appreciated by the skilled person, the specific relationship and the values used will vary dependent on a number of factors including the material and specific crystalline structure/poling of the piezoelectric element, the geometry of the device (for example the length/width/height of the layers), and/or the efficiency of the device. For example, the efficiency of piezoelectric materials can normally vary by +/−10% and may vary up to +/−20% in an extreme circumstance. It will be appreciated that there is no requirement for the relationship between displacement and applied electric field to be linear.

Furthermore, the amount of deflection required will be dependent on the specific application but in general deflection will be in the order of 20 μm to 60 μm, but deflection up to 600 μm can be used.

Furthermore, whilst the embodiments above teach modifying the drive signals applied to the electrodes on the various piezoelectric layers simultaneously, it will be understood that alternative embodiments may use a specific driving strategy whereby the signals applied to the various electrodes are not varied simultaneously.

Furthermore, the specific configuration of piezoelectric layers, e.g. numbers of layers, poling etc. can be modified whilst retaining the desired advantages of reduced frictional wear due to e.g. impact between a valve surface and a stop surface when using the actuator in a printhead for droplet ejection.

It is preferable to provide a device having poling/voltage differentials which result in contraction as opposed to expansion because repeated expansion may lead to de-poling of the layers over time, whilst expansion using voltages >500V is known to increase the likelihood of de-poling.

Whilst the voltages/voltage differentials described above relate to DC, it will be appreciated that certain types of actuators could be driven using AC voltage or using current control to achieve the advantageous functionality, whilst the specific voltages/voltage differentials required to provide the functionality will be dependent on various factors as outlined above, and which will be apparent to the skilled person upon reading this specification.

It will be appreciated that whilst bimorph piezoelectric elements are described in the embodiments above, whereby the elements are retained/fixed towards both ends to allow the elements to deflect in a concave or convex direction relative to a stop surface, the elements may be fixed at one end so as function as a cantilever having an obturator assembly attached thereto to control droplet ejection. Single layer bender style actuators mounted to inert metal substrates could also be used, e.g. "thunder style actuators." Alternatively, the piezoelectric element may be arranged as both chevron and monolithic piezoelectric elements as will be appreciated by a person skilled in the art.

It will also be seen that using actuators other than piezoelectric actuators could also be used to provide the same driving functionality to effect droplet ejection, for example electrostatic actuators, magnetic actuators, electrostrictive actuators, thermal uni/bi morph elements, solenoids, shape memory alloys etc. could readily be used to provide the functionality described above whilst obtaining the desirable functionality as will be apparent to the skilled person upon reading the above specification.

Furthermore, the pressures values described above relate to gauge pressure. However it will be appreciated that absolute pressure may also be used as a measurement of the pressure in the system.

The invention claimed is:

1. A method of driving an actuator (1) for a printhead, wherein the actuator (1) comprises:

an actuating element (2);

an obturator assembly (3), engagable with the actuating element (2), the actuating element (2) is operable to assume, depending on a drive signal applied thereto:

a rest configuration, in which the obturator assembly (3) is at a first distance (X0) from a reference plane (A);

a first deformed configuration, in which the obturator assembly (3) is at a second distance (X1) from the reference plane (A) greater than the first distance (X0);

and a second deformed configuration, in which the obturator assembly (3) is in contact with the reference plane (A); characterized in that the method comprises:

supplying the drive signal during a first operating cycle to the actuating element (2) to cause the obturator assembly (3) to move between the rest configuration and the first deformed configuration.

2. The method according to claim 1, wherein the method comprises supplying the drive signal to the element (2) during a second operating cycle, to cause the actuating element to pass the rest configuration to the second deformed configuration.

3. The method according to claim 1, wherein the actuator element is a piezoelectric element.

4. The method according to claim 1 wherein the drive signal is provided as a voltage waveform.

5. The method according to claim 1 wherein the drive signal comprises print data.

6. An actuator (1), for a printhead, wherein the actuator (1) comprises:

an actuating element (2)

an obturator assembly (3), engageable with the actuator element (2); wherein the actuating element (2) is operable to assume, depending on a drive signal applied thereto:

a rest configuration, in which the obturator assembly (3) is at a first distance (X0) from a reference plane (A);

a first deformed configuration, in which the obturator assembly (3) is at a second distance (X1) from the reference plane (A) greater than the first distance (X0), and a second deformed configuration, in which the obturator assembly (3) is in contact with the reference plane (A), wherein:

a control module (4) is configured for regulating a drive signal to the actuating element (2) to cause the obturator assembly (3) to move between the rest configuration and the first deformed configuration during a first operating cycle.

7. The actuator according to claim 6, wherein the control module (4) is configured for regulating the drive signal to cause the actuating element (3) to pass the rest configuration to the second deformed configuration during a second operating cycle.

8. The actuator according to claim 6, wherein the actuating element comprises at least one piezoelectric layer.

9. The actuator according to claim 8, wherein the at least one piezoelectric layer is arranged as a bimorph.

10. The actuator according to claim 8, wherein the actuating element comprises a plurality of piezoelectric layers.

11. The actuator according to claim 10, wherein the piezoelectric layers are operable to be controlled using a first voltage applied to a first electrode associated with the plurality of layers; a second voltage applied to a second electrode associated with the plurality of layers, and a third voltage applied to a third electrode associated with the plurality of layers.

12. The actuator according to claim 11, wherein the first voltage is higher than the second voltage and wherein the third voltage is controllable to be at or between the first and second voltage levels.

13. The actuator according to claim 6, wherein the obturator assembly (3) comprises a sealing surface (31) operable to contact the reference plane (A) in the second deformed configuration of the piezoelectric element (2).

14. A printhead for inkjet printing, comprising:

an actuator (1) according to claim 6;

a nozzle portion (5) having a nozzle inlet (61), a nozzle (6) and a nozzle outlet (62), wherein the nozzle inlet is arranged on a stop surface (51) of the nozzle arranged on the reference plane (A).

15. The printhead according to claim 14, wherein the first operating cycle is operable to generate at least one droplet from the nozzle outlet.

16. The printhead according to claim 14, wherein the second operating cycle is operable to prevent droplet ejection from the nozzle outlet.

17. The printhead according to claim 14, wherein the fluid comprises glaze.

18. The printhead according to claim 14, wherein the fluid comprises engobe.

19. The method according to claim 1 wherein said printhead comprises said actuator (1), a nozzle portion (5) having a nozzle inlet (61), a nozzle (6) and a nozzle outlet (62), wherein the nozzle inlet is arranged on a stop surface (51) of the nozzle arranged on the reference plane (A);

wherein a control module (4) is configured for regulating a drive signal to the actuating element (2) to cause the obturator assembly (3) to move between the rest configuration and the first deformed configuration during a first operating cycle;

wherein the method includes a step of generating at least one droplet.

20. A printer comprising the printhead of claim 14.

* * * * *